US008881624B2

(12) United States Patent
Huang

(10) Patent No.: US 8,881,624 B2
(45) Date of Patent: Nov. 11, 2014

(54) TOOL HANDLE

(71) Applicant: Chin-Tan Huang, Taichung (TW)

(72) Inventor: Chin-Tan Huang, Taichung (TW)

( * ) Notice: Subject to any disclaimer, the term of this patent is extended or adjusted under 35 U.S.C. 154(b) by 0 days.

(21) Appl. No.: 13/867,593

(22) Filed: Apr. 22, 2013

(65) Prior Publication Data

US 2014/0102266 A1 Apr. 17, 2014

(30) Foreign Application Priority Data

Oct. 11, 2012 (TW) ..... 101219638 U

(51) Int. Cl.
*B25B 23/16* (2006.01)
*B25G 1/04* (2006.01)
*B25G 1/06* (2006.01)

(52) U.S. Cl.
CPC . *B25G 1/04* (2013.01); *B25G 1/066* (2013.01)
USPC ..... 81/177.9; 81/177.8; 81/489

(58) Field of Classification Search
USPC ..... 81/177.7, 177.8, 177.9, 489; 403/68, 403/71, 78, 91, 98, 160, 204; 16/110.1, 900
See application file for complete search history.

(56) References Cited

U.S. PATENT DOCUMENTS

| | | | | | |
|---|---|---|---|---|---|
| 1,080,121 | A * | 12/1913 | Oriol | 81/177.8 |
| 2,542,038 | A * | 2/1951 | Lewis | 173/206 |
| 4,759,240 | A * | 7/1988 | Lin | 81/177.8 |
| 7,434,496 | B2 * | 10/2008 | Hu | 81/177.7 |
| 7,481,135 | B2 * | 1/2009 | Schoenbeck et al. | 81/177.7 |
| 8,397,607 | B2 * | 3/2013 | Huang | 81/177.8 |
| 2013/0239757 | A1 * | 9/2013 | Chen | 81/177.4 |
| 2014/0000422 | A1 * | 1/2014 | Huang | 81/489 |

* cited by examiner

*Primary Examiner* — Monica Carter
*Assistant Examiner* — Melanie Alexander
(74) *Attorney, Agent, or Firm* — Novak Druce Connolly Bove + Quigg LLP

(57) ABSTRACT

A tool handle includes a first handle unit, a joint unit connected rotatably to the first handle unit and formed with a plurality of positioning grooves, a second handle unit connected co-rotatably to the joint unit, and a latch member inserted into the first handle unit and movable between a lock state, where two latching projections of the latch member engage two of the positioning grooves and the first and second handle units are non-rotatable relative to each other, and an unlock state, where the latching projections are disengaged from the two of the positioning grooves and the second handle unit is rotatable about the engaging block to permit adjustment of an orientation of the second handle unit relative to the first handle unit.

11 Claims, 7 Drawing Sheets

TOOL HANDLE

CROSS-REFERENCE TO RELATED APPLICATION

This application claims priority of Taiwanese Application No. 101219638, filed on Oct. 11, 2012.

BACKGROUND OF THE INVENTION

1. Field of the Invention

The invention relates to a tool handle, more particularly to a tool handle that is adapted to be connected to a tool head and that has a handle unit whose orientation relative to the tool head is adjustable.

2. Description of the Related Art

Referring to FIG. 7, a conventional tool handle 10 is shown to include a first handle 11, a second handle 12, an operating member 13 connected movably to the second handle 12, and a lock member 14 mounted in the second handle 12 and connected co-movably to the operating member 13.

The first handle 11 has an inclined first surface 111, an engaging protrusion 112 protruding from the first surface 111, and a pair of diametrically spaced-apart locking grooves 113 formed in the first surface 111 and disposed at opposite sides of the engaging protrusion 112. The second handle 12 has an inclined second surface 121 confronting the first surface 111, and an engaging hole 122 formed in the second surface 121 and engaged rotatably with the engaging protrusion 112.

When the operating member 13 is operated to move the lock member 14 to engage one of the locking grooves 113, the first and second handles 11, 12 are non-rotatable relative to each other. When the operating member 13 is operated to move the lock member 14 to be disengaged from the one of the locking grooves 113, the second handle 12 is rotatable about the engaging protrusion 112 of the first handle 11 to register the other one of the locking grooves 113 with the lock member 14. Then, the lock member 14 is further operable to engage the other one of the lock groove 113 to restrain further rotation of the second handle 12 relative to the first handle 11. As a result, an orientation of the second handle 12 relative to the first handle 11 is adjusted.

In use, when the second handle 12 is mounted with a tool head and the conventional tool handle 10 is rotated to drive rotation of the tool head to, for example, unfasten a screw, the lock member 14 is subjected to a shear force due to a torque transferred from the first handle 11 to the second handle 12. However, since the lock member 14 has a relatively weak structure, it may easily fracture once the torque is too large. Additionally, since the conventional tool handle 10 has only two locking grooves 113, the flexibility of the orientation adjustment of the second handle unit 12 is limited.

SUMMARY OF THE INVENTION

Therefore, the object of the present invention is to provide a tool handle having a relatively strong structure and a greater operating flexibility.

Accordingly, a tool handle of the present invention comprises:

a first handle unit including a first handle body that has a first axis and a handle end surface oblique to the first axis, and an engaging block that protrudes from the handle end surface;

a joint unit mounted rotatably around the engaging block and having an annular end surface that confronts the handle end surface and that surrounds the engaging block, and a plurality of spaced-apart and annularly-arranged positioning grooves formed in the annular end surface;

a second handle unit including a second handle body that has a second axis, that defines a retaining space therein for retaining the joint unit, and that is co-rotatable with the joint unit; and a lock unit including a latch member that is inserted movably into the first handle unit, that has at least two spaced-apart latching projections projecting toward the annular end surface, and that is operable to switch between a lock state where the latching projections engage respectively at least two of the positioning grooves, and an unlock state where the latching projections are disengaged from the at least two of the positioning grooves;

wherein, the first and second handle units are non-rotatable relative to each other when the latch member is at the lock state, and the second handle unit is rotatable about the engaging block to thereby adjust an orientation of the second handle unit relative to the first handle unit when the latch member is at the unlock state.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
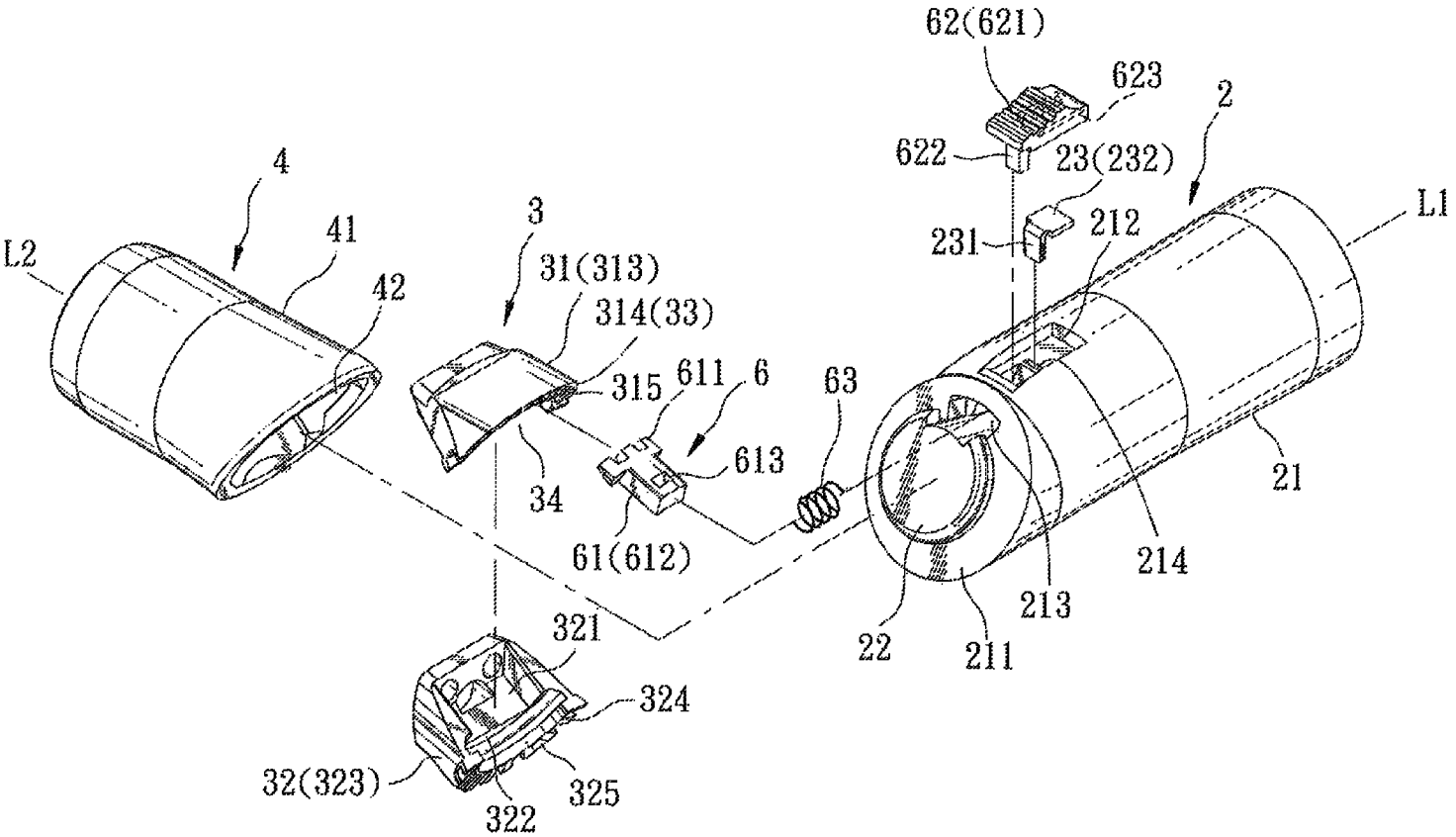
FIG. 1 is an exploded perspective view of a preferred embodiment of a tool handle according to the invention.
Figure 2:
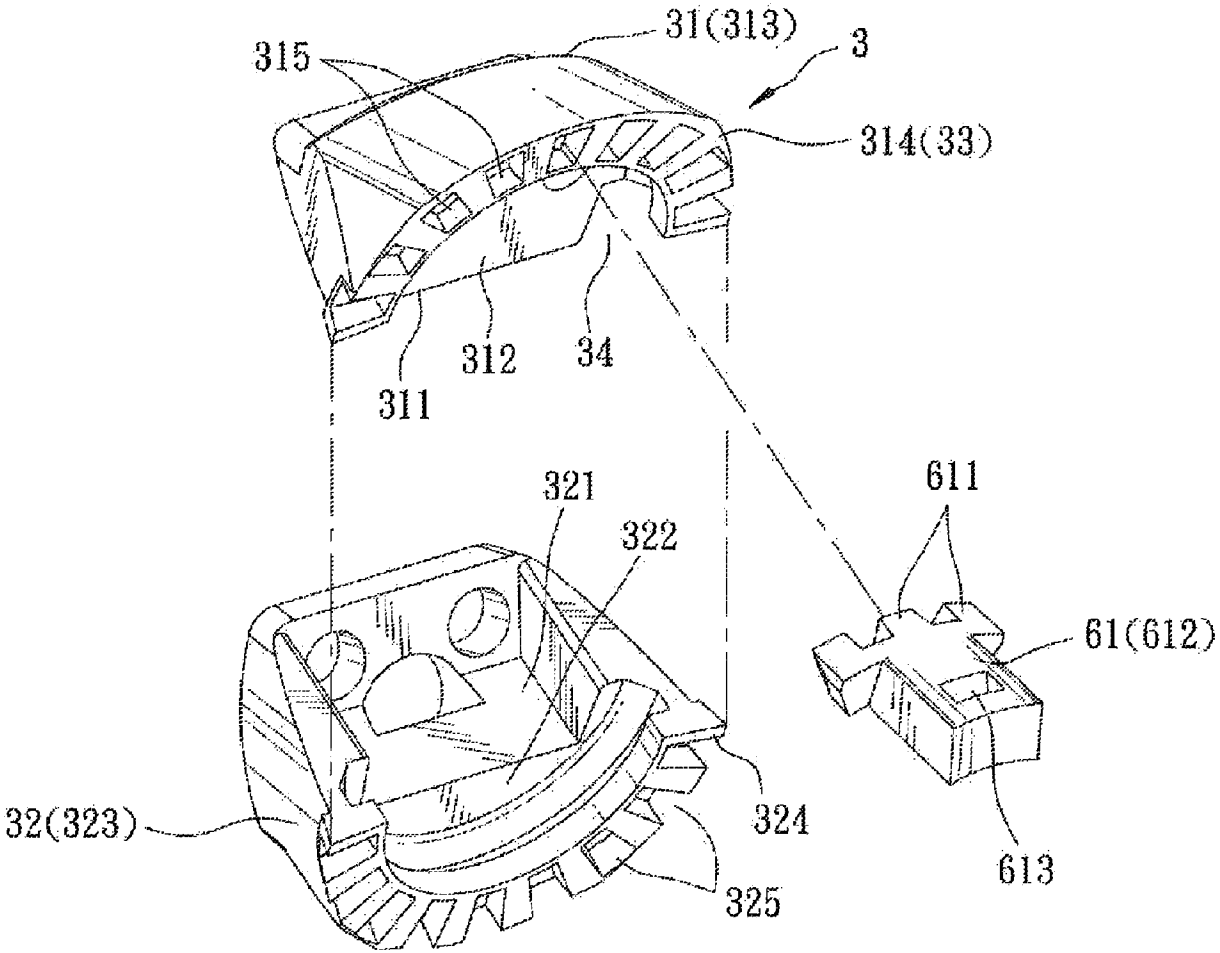
FIG. 2 is an exploded perspective view of a joint unit and a latch member of the preferred embodiment.
Figure 3:
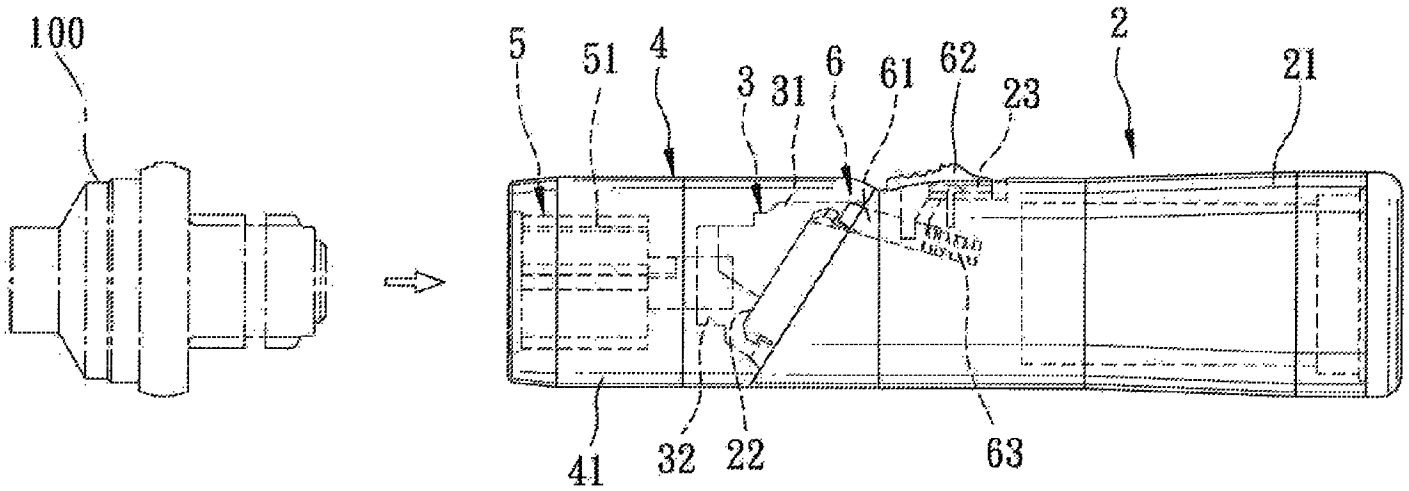
FIG. 3 is a schematic side view of the preferred embodiment.

As shown in FIGS. 1 to 3, a preferred embodiment of a tool handle according to the present invention is adapted for connection with a tool head 100 (see FIG. 3). The tool handle comprises a first handle unit 2, a joint unit 3, a second handle unit 4, an installing unit 5, and a lock unit 6.

The first handle unit 2 includes a first handle body 21, an engaging block 22, and a guide piece 23.

The first handle body 21 has a first axis (L1), a handle end surface 211 oblique to the first axis (L1), a knob groove 212 formed in an outer surrounding surface thereof, and a latch groove 213 extending inwardly from the handle end surface 211 and communicating spatially with the knob groove 212. In this embodiment, the knob groove 212 is oblong and extends in the direction of the first axis (L1). The first, handle body 21 further has an installing hole 214 extending inwardly from the knob groove 212.

The engaging block 22 is configured to be cylindrical, and protrudes perpendicularly from the handle end surface 211. A cross-section of the engaging block 22 is smaller than the handle end surface 211.

The guide piece 23 has an installing portion 231 engaging detachably the installing hole 214, and a guide portion 232 connected to the installing portion 231 and disposed in the knob groove 212. In this embodiment, the guide portion 232 is perpendicular to the installing portion 231 and extends in the direction of the first axis (L1).

The joint unit 3 is mounted rotatably around the engaging block 22 and includes first and second complementing pieces 31, 32.

Each of the first and second complementing pieces 31, 32 has a bulk portion 311, 321, a bulk surface 312, 322 formed on the bulk portion 311, 321 and confronting the engaging block 22, a bulk wall portion 313, 323 extending around the bulk surfaces 312, 322 and toward the handle end surface 211, an arcuate end surface 314, 324 formed at a distal end of the bulk wall portion 313, 323 and confronting the handle end surface 211, and a plurality of positioning grooves 315, 325 formed in the arcuate end surface 314, 324. The bulk portions 311, 321 of the first and second complementing pieces 31, 32 are interconnected complementarily. The bulk surfaces 312, 322 of the first and second complementing pieces 31, 32 are coplanar. The arcuate end surfaces 314, 324 complement with each other to form an annular end surface 33 that surrounds the engaging block 22. The positioning grooves 315, 325 are spaced apart from one another and are annularly arranged. The bulk wall portions 313, 323 and the bulk surfaces 312, 322 cooperatively define an engaging space 34 that is engaged rotatably with the engaging block 22.

The second handle unit 4 includes a second handle body 41 that has a second axis (L2), that defines a retaining space 42 in one end thereof for retaining the joint unit 3, and that is co-rotatable with the joint unit 3.

In this embodiment, the installing unit 5 has an installing space 51 formed in the second handle unit 4 for receiving the tool head 100.

The lock unit 6 includes a latch member 61, a push knob 62, and a resilient member 63.

The latch member 61 is disposed movably in the latch groove 213 and has at least two spaced-apart latching projections 611 projecting toward the annular end surface 33 of the joint unit 3, and an arm segment 612 connected to the latching projections 611, extending oppositely of the joint unit 3, and having a first connecting section 613. The latch member 61 is operable to switch between a lock state (see FIG. 4), where the latching projections 611 engage respectively at least two of the positioning grooves 315, 325 (only one latching projection 611 is visible to engage one of the positioning grooves 315, 325 in FIG. 4), and an unlock state (see FIG. 5), where the latching projections 611 are disengaged from the at least two of the positioning grooves 315, 325. In this embodiment, the latch member 61 has three of the latching projections 611 arranged along an arcuate line which has a curvature substantially corresponding to that of an annular line along which the positioning grooves 315, 325 are angularly spaced apart from each other.

The push knob 62 has a knob portion 621 disposed movably in the knob groove 212, and a second connecting portion 622 connected to the knob portion 621 for co-movable connection with the first connecting section 613 of the latch member 61. The knob portion 621 is formed with a guide groove 623 extending in the direction of the first axis (L1) and engaged slidably with the guide portion 232 of the guide piece 23. In this embodiment, the first connecting section 613 is configured as a hole, and the second connecting portion 622 is configured as a column that is inserted into the hole. The push knob 62 is movable in the direction of the first axis (L1) to actuate the latch member 61 to switch between the lock state and the unlock state.

The resilient member 63 is configured as a compression spring and is disposed in the latch groove 213 for biasing the latch member 61 toward the lock state.

Figure 4:
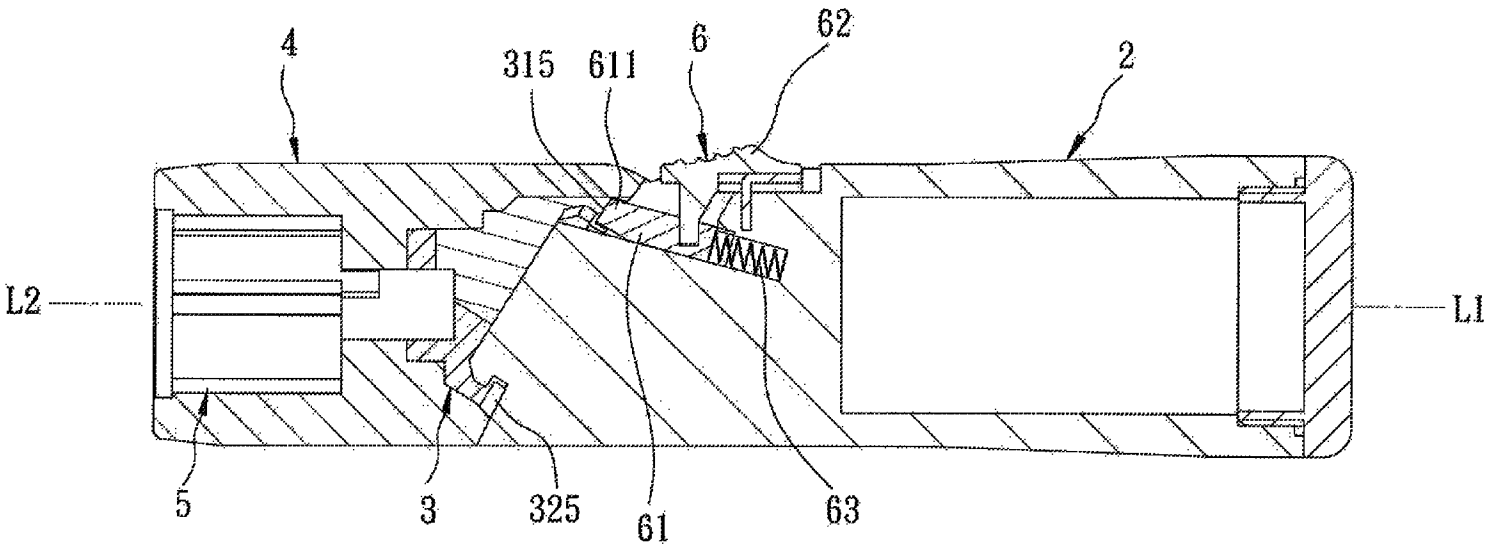
FIG. 4 is a sectional view illustrating the preferred embodiment at a first position.

Referring to FIG. 4, before adjustment of the orientation of the first handle unit 2 relative to the second handle unit 4, the tool handle of the preferred embodiment is in a first position, where the first axis (L1) and the second axis (L2) are collinearly disposed for facilitating storage of the tool handle of the preferred embodiment, where the resilient member 63 pushes the latch member 61 to the lock state, and where the latching projections 611 engage respectively three adjacent ones of the positioning grooves 315, 325. The engagement between the latching projections 611 and the positioning grooves 315, 325 restrains the rotation of the joint unit 3 relative to the first handle unit 2, so that the first and second handle units 2, 4 are non-rotatable relative to each other.

Figure 5:
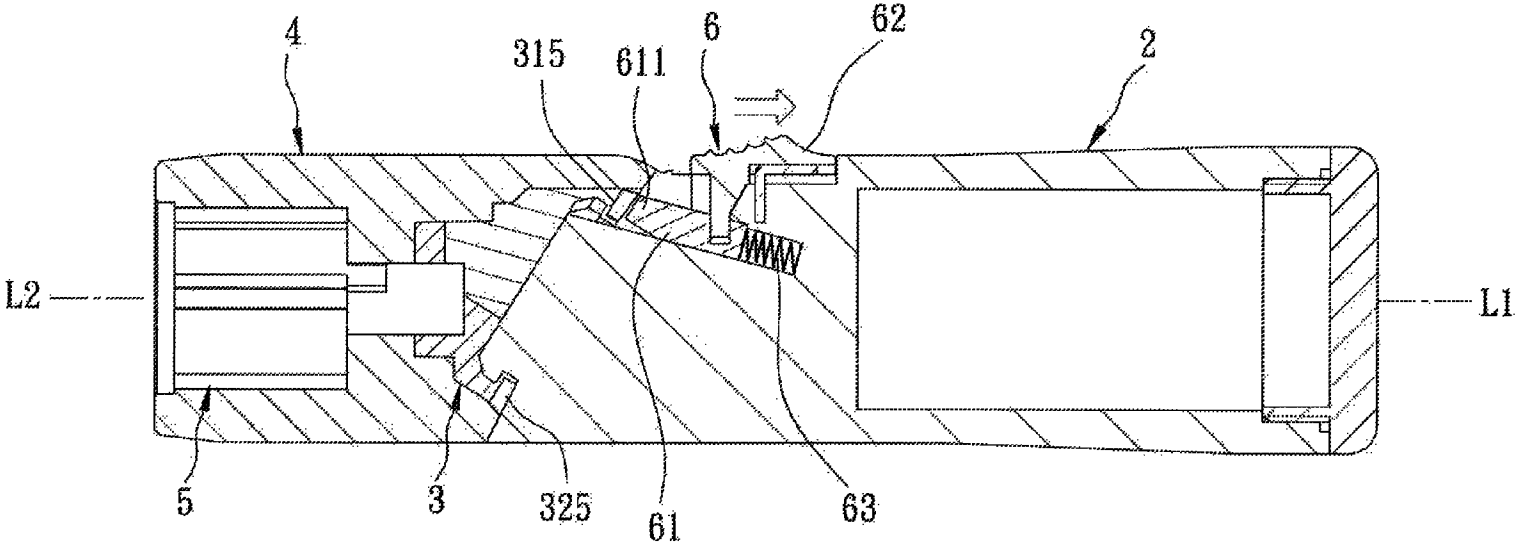
FIG. 5 is another sectional view of the preferred embodiment, in which the latch member is at an unlock state.

Referring to FIG. 5, to adjust the orientation of the second handle unit 4 relative to the first handle unit 2, the push member 62 is pushed to disengage the latching projections 611 from the corresponding positioning grooves 315, 325 against a biasing force of the resilient member 63. Thus, the joint unit 3 and the second handle unit 4 are allowed to be rotated relative to the first handle unit 2.

Figure 6:
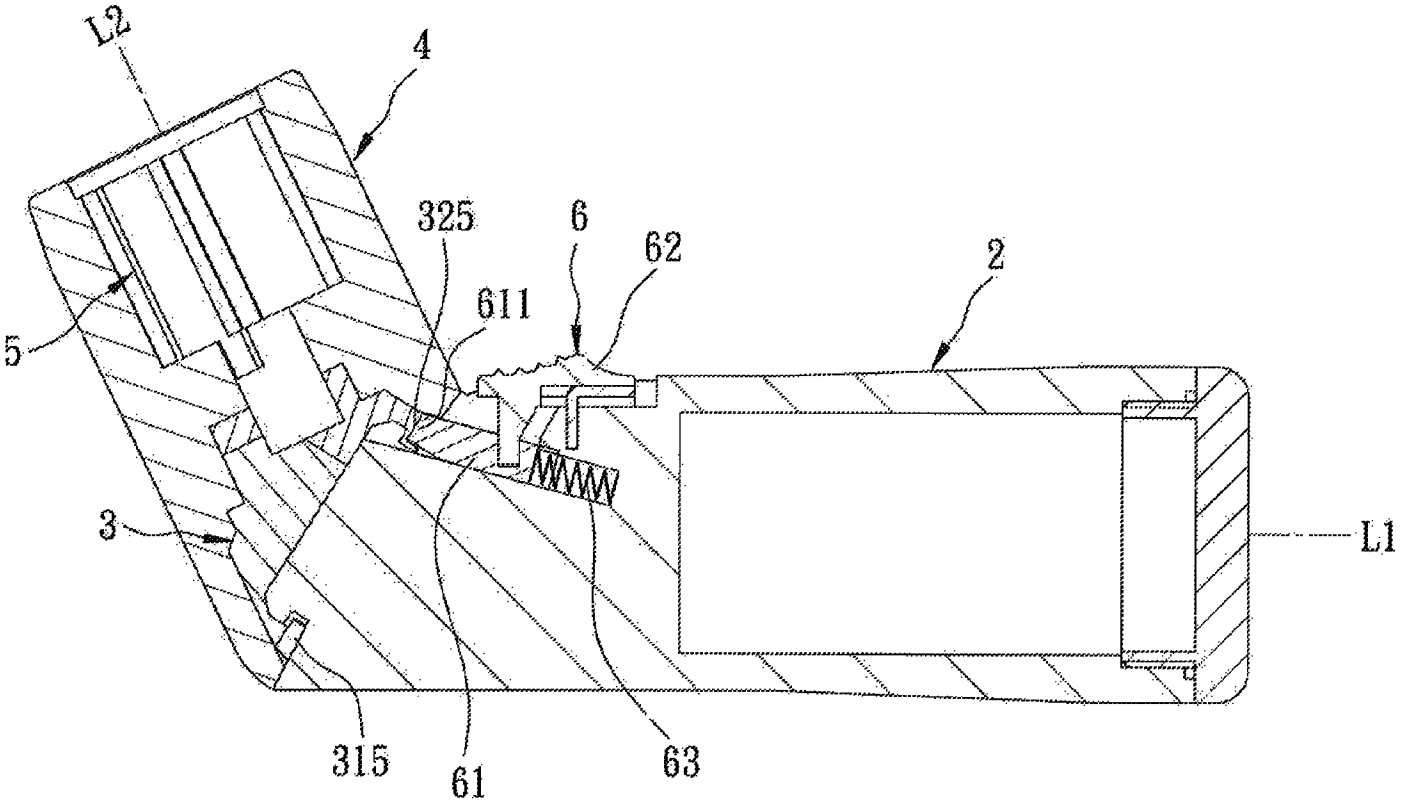
FIG. 6 is still another sectional view illustrating the preferred embodiment at a second position.
Figure 7:
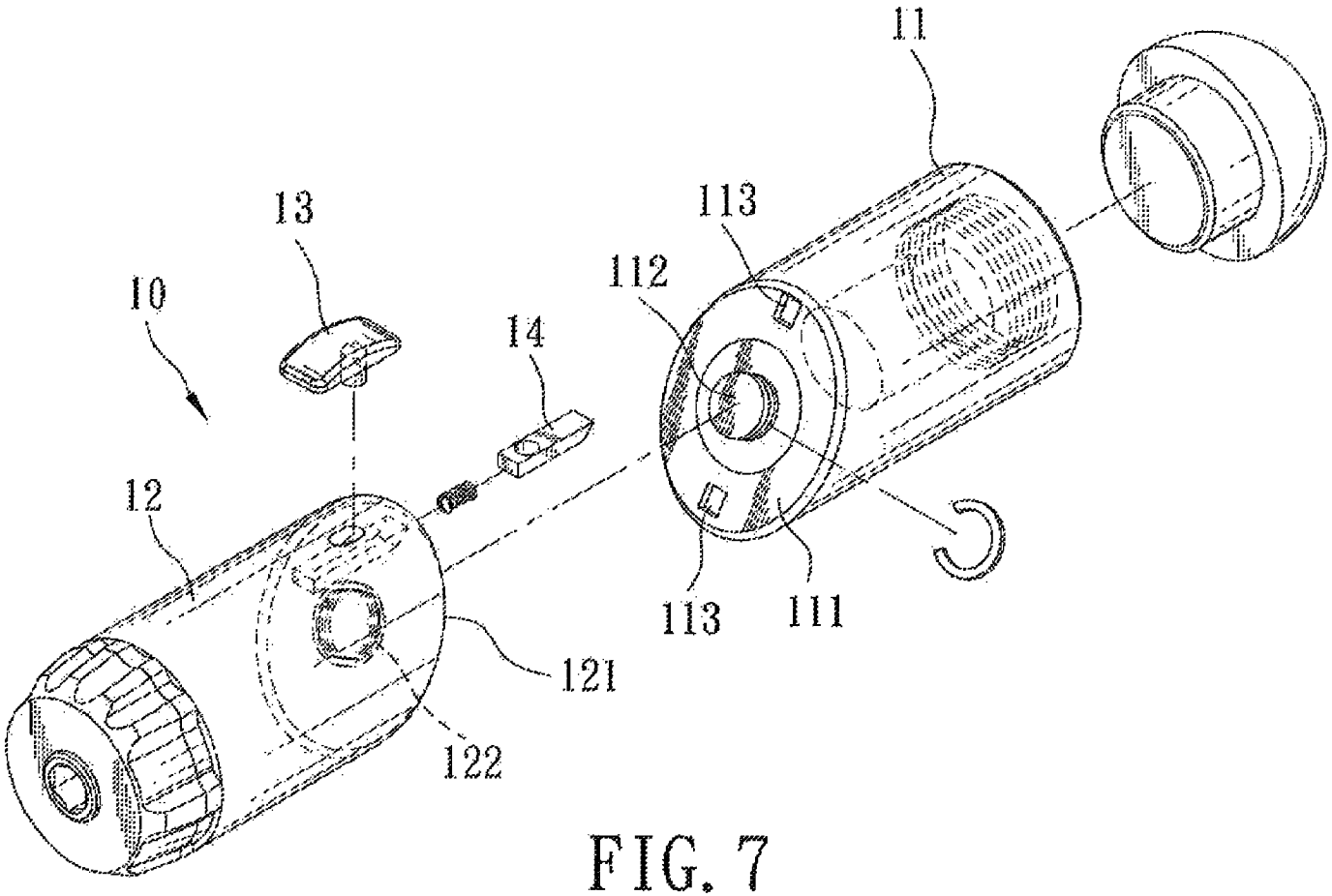
FIG. 7 PRIOR ART
FIG. 7 is an exploded perspective view of a conventional tool handle.

Referring further to FIG. 6, when the joint unit 3 and the second handle unit 4 are rotated about the engaging block 22 of the first handle unit 2 to a second position where the latching projections 611 are registered with another three adjacent ones of the positioning grooves 315, 325, the push member 62 is released to restore the latch member 61 to the lock state by a restoring force of the resilient member 63. At this time, the first axis (L1) and the second axis (L2) are non-collinear with each other, and the orientation of the second handle unit 4 relative to the first handle unit 2 is adjusted. By virtue of the engagement between the latching projections 611 and the positioning grooves 315, 325, the second handle unit 4 would be firmly positioned relative to the first handle unit 2.

The tool handle of this invention has several advantages:

1. When the tool handle is mounted with the tool head 100 to serve as a hand tool, a shear force due to a torque transferred from the first handle unit 2 to the joint unit 3 during operation of the hand tool would be distributed evenly on the latching projections 611. Thus, compared to the conventional tool handle disclosed in the prior art, the tool handle of the present invention has greater structural strength and can bear a larger torque.

2. The plural arrangement of the positioning grooves 315, 325 provides more than two different sets of the positioning grooves 315, 325 to be engaged with the latching projections 611 of the latch member 61, so that the second handle unit 4 can be positioned at more than two different orientations relative to the first handle unit 2, thereby resulting in greater flexibility during use.

It is noted that, in other embodiments of this invention, the installing unit 5 may be omitted with the tool head 100 being formed fixedly and integrally on the second handle unit 4.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A tool handle comprising:

a first handle unit including a first handle body that has a first axis and a handle end surface oblique to the first axis, and an engaging block that protrudes from said handle end surface;

a joint unit mounted rotatably around said engaging block and having an annular end surface that confronts said handle end surface and that surrounds said engaging block, and a plurality of spaced-apart and annularly-arranged positioning grooves formed in said annular end surface;

a second handle unit including a second handle body that has a second axis, that defines a retaining space therein for retaining said joint unit, and that is co-rotatable with said joint unit; and a lock unit including a latch member that is inserted movably into said first handle unit, that has at least two spaced-apart latching projections projecting toward said annular end surface, and that is operable to switch between a lock state where said latching projections engage respectively at least two of said positioning grooves, and an unlock state where said latching projections are disengaged from the at least two of said positioning grooves;

wherein, said first and second handle units are non-rotatable relative to each other when said latch member is at the lock state, and said second handle unit is rotatable about said engaging block to thereby adjust an orientation of said second handle unit relative to said first handle unit when said latch member is at the unlock state.

2. The tool handle as claimed in claim 1, wherein:

said first handle body further has a knob groove formed in a surrounding surface thereof, and a latch groove extending inwardly from said handle end surface and communicating spatially with said knob groove, said latch member being disposed movably in said latch groove; and said lock unit further includes a push knob disposed movably in said knob groove, connected co-movably to said latch member, and movable in the direction of the first axis to actuate said latch member to switch between the lock state and the unlock state, and a resilient member disposed in said latch groove for biasing said latch member toward the lock state.

3. The tool handle as claimed in claim 2, wherein said latch member further has an arm segment connected to said latching projections and having a first connecting section, said push knob having a knob portion that is disposed movably in said knob groove, and a second connecting portion that is connected to said knob portion for connection with said first connecting section.

4. The tool handle as claimed in claim 3, wherein said first connecting section is configured as a hole, said second connecting portion being configured as a column that is inserted into said hole.

5. The tool handle as claimed in claim 3, wherein said first handle unit further includes a guide piece disposed in said knob groove, said knob portion of said push knob being formed with a guide groove that is engaged slidably with said guide piece.

6. The tool handle as claimed in claim 5, wherein said first handle body further has an installing hole extending inwardly from said knob groove, said guide piece having an installing portion that engages said installing hole, and a guide portion that is connected to said installing portion and that is disposed in said knob groove for engaging slidably said guide groove of said knob portion of said push knob.

7. The tool handle as claimed in claim 1, wherein said latching projections are arranged along an arcuate line which has a curvature substantially corresponding to that of an annular line along which said positioning grooves are angularly spaced apart from each other.

8. The tool handle as claimed in claim 1, wherein said latch member has three of said latching projections.

9. The tool handle as claimed in claim 1, wherein said joint unit includes first and second complementing pieces, said first and second complementing pieces respectively having arcuate end surfaces that complement with each other to form said annular end surface.

10. The tool handle as claimed in claim 3, wherein each of said first and second complementing pieces has a bulk portion, a bulk surface that is formed on said bulk portion and that confronts said engaging block, and a bulk wall portion that extends around said bulk surface and toward said handle end surface, said arcuate end surfaces being formed respectively at distal ends of said bulk wall portions, said bulk portions of said first and second complementing pieces being interconnected complementarily, said bulk surfaces of said first and second complementing pieces being coplanar, said bulk wall portions and said bulk surfaces cooperatively defining an engaging space that is engaged with said engaging block.

11. The tool handle as claimed in claim 1, further comprising an installing unit having an installing space that is formed in one of said first and second handle units and that is adapted for receiving a tool head.

* * * * *